United States Patent [19]

Raemdonck

[11] Patent Number: 4,844,054

[45] Date of Patent: Jul. 4, 1989

[54] APPARATUS DESIGNED FOR EXERCISING THE REAR LEG MUSCLES AS WELL AS THE LOWER DORSAL MUSCLES OF A PATIENT

[75] Inventor: René V. Raemdonck, Ninove, Belgium

[73] Assignee: "Handi-Move", Belgium

[21] Appl. No.: 162,956

[22] Filed: Mar. 2, 1988

[30] Foreign Application Priority Data

Mar. 5, 1987 [BE] Belgium ..... 8700215

[51] Int. Cl.[4] ..... A61H 1/02

[52] U.S. Cl. ..... 128/25 R

[58] Field of Search ..... 272/94, 116, 134, 130, 272/144, 117, 136, 96; 128/25 R, 69, 70, 72, 73

[56] References Cited

U.S. PATENT DOCUMENTS

| | | | |
|---|---|---|---|
| 1,537,464 | 5/1925 | Hummel, Jr. | 128/25 R |
| 1,626,471 | 4/1927 | Miller | 128/73 |
| 1,969,901 | 8/1934 | Pilates | 272/134 |
| 1,973,945 | 9/1934 | Chavin | 272/134 |
| 2,130,922 | 9/1938 | Hawley | 128/70 |
| 2,598,204 | 5/1952 | Allen | 272/130 X |
| 2,827,046 | 3/1958 | Hewell et al. | 128/70 |
| 4,387,894 | 6/1983 | Baumann | 272/130 |
| 4,444,390 | 4/1984 | Erickson | 272/130 |
| 4,460,171 | 7/1984 | Plyhm | 272/94 |
| 4,583,731 | 4/1986 | Crivello et al. | 272/136 X |
| 4,666,152 | 5/1987 | Jones | 272/116 X |

FOREIGN PATENT DOCUMENTS

| | | | |
|---|---|---|---|
| 3343634 | 6/1985 | Fed. Rep. of Germany | 272/134 |

*Primary Examiner*—Richard J. Apley
*Assistant Examiner*—Howard Flaxman
*Attorney, Agent, or Firm*—Watson, Cole, Grindle & Watson

[57] ABSTRACT

Apparatus for exercising the rear leg muscles as well as the lower dorsal muscles of a patient which includes an elongated bench having a footrest at one end which is adjustable in the longitudinal direction of the bench and a dorsal support at the other end attached to a vertically revolvable arm, and a drive device to move the revolvable arm in the vertical plane for bringing to bear an adjustable pressure on the patient's back by movement of the dorsal support.

6 Claims, 2 Drawing Sheets

APPARATUS DESIGNED FOR EXERCISING THE REAR LEG MUSCLES AS WELL AS THE LOWER DORSAL MUSCLES OF A PATIENT

BACKGROUND OF THE INVENTION

This invention concerns an apparatus designed for exercising the rear leg muscles as well as the lower dorsal muscles of a patient.

In particular, the apparatus according to the invention aims at making possible a therapy for back complaints and injuries caused by:

1. shortening of the rear leg muscles (postural muscles) i.e. "hamstrings" and "gastrocnemius";
2. the round sitting posture of the low spinal column or a stiffening thereof.

Overly short hamstrings are rear leg muscles which display a lack of elasticity that may bring about numerous complaints that will not be discussed further within the framework of this patent application.

SUMMARY OF THE INVENTION

In view of attaining the objective set, i.e., exercising the rear leg muscles and the lower dorsal muscles in an effective manner and without the help of any physical therapist or nursing staff, the apparatus consists of an elongated bench with, at one end, a support adjustable in the longitudinal direction of the bench for the feet of the patient who will rest in the longitudinal direction of this bench and, at the other end, a dorsal support assembled to a vertically revolvable arm and, finally, a system designed to move the aforesaid revolvable arm in the vertical plane in view of bringing to bear an adjustable pressure on the patients's back by means of the aforesaid dorsal support.

Still according to the invention, the aforesaid revolvable arm is part of a right-angled component that is hinged to the aforesaid bench and the aforesaid system for moving the aforesaid arm in the vertical plane consists of a hydraulic cylinder.

Other details and advantages of the invention will be shown by the following description of an apparatus designed for exercising the rear leg muscles as well as the lower dorsal muscles of a patient. This description is provided as an example only and does not restrict the invention. The reference numbers are relating to the figures appended hereto.

DETAILED DESCRIPTION OF THE PREFERRED EMBODIMENT

Figure 1:
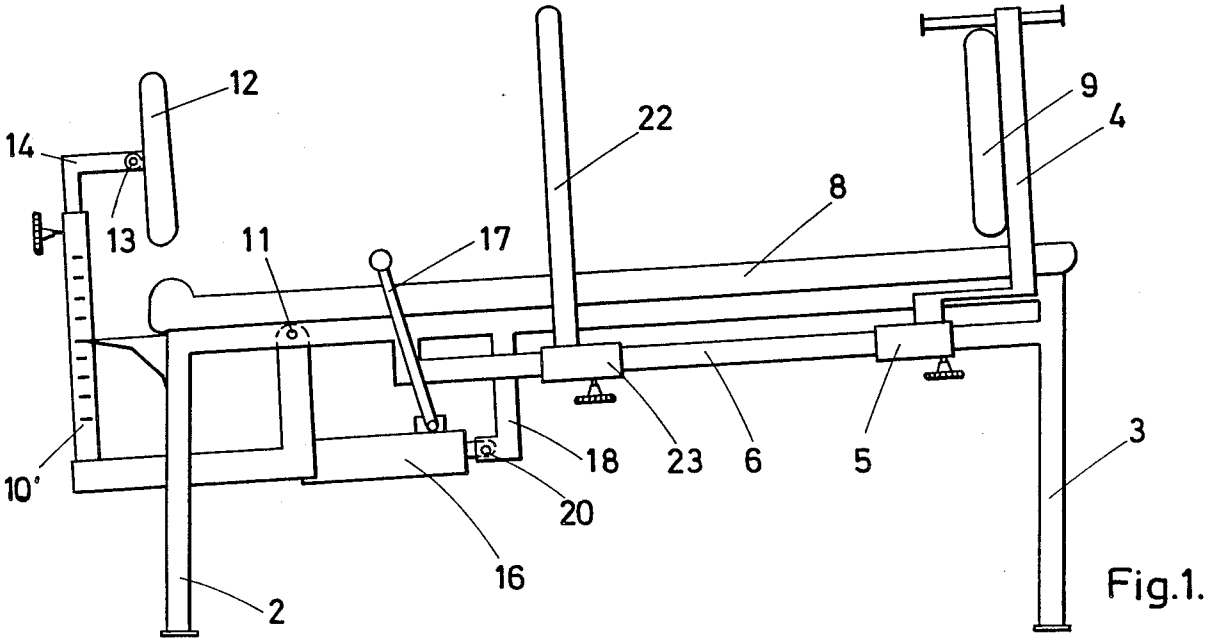
FIG. 1 is a side view of the apparatus according to the invention.
Figure 2:
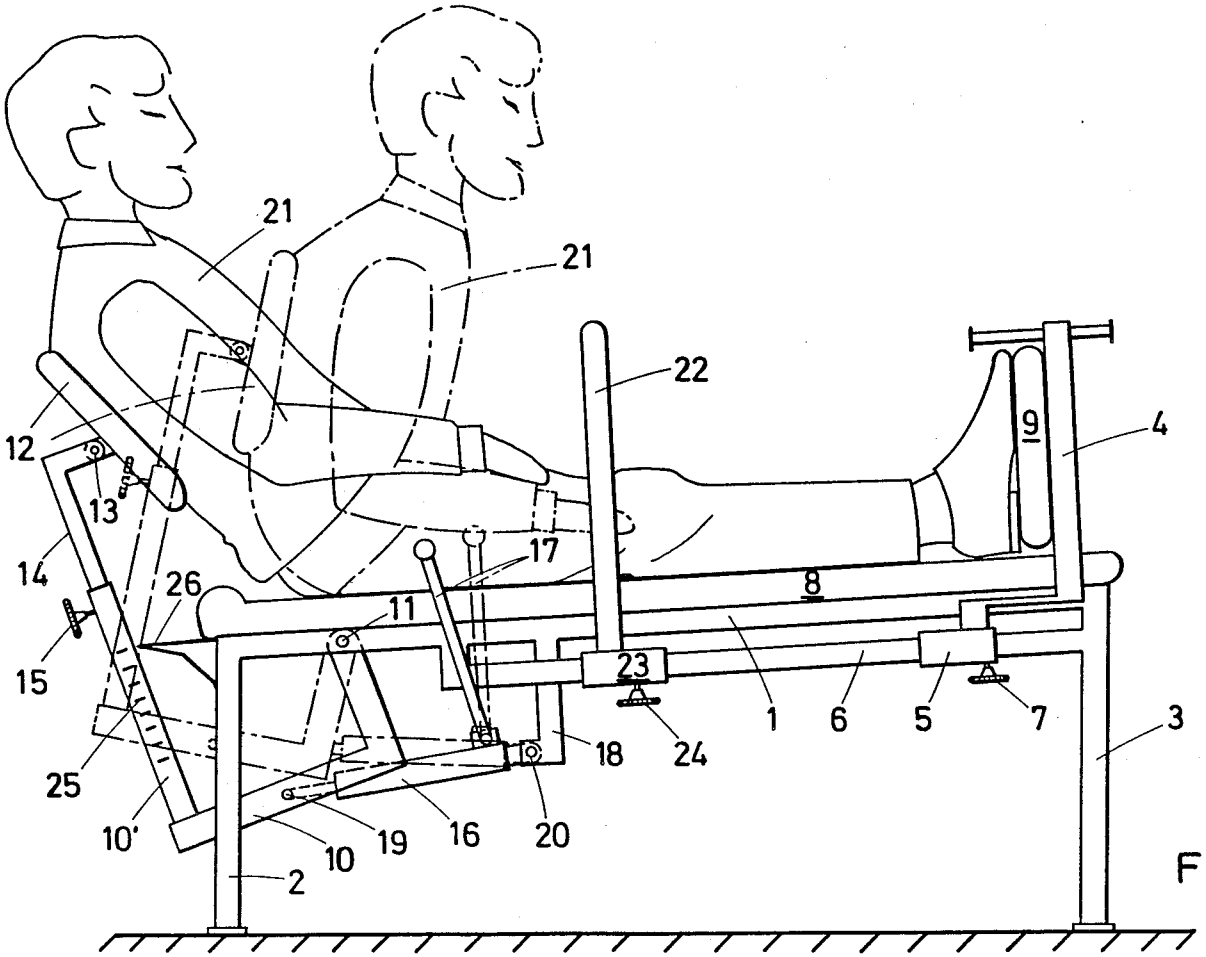
FIG. 2 is a side view of the apparatus according to the invention, with the revolvable arm and the patient shown in two positions.

The apparatus shown in FIGS. 1 and 2 consists of an elongated bench, the frame of which is built conventionally of longitudinal girders 1, of cross girders (not shown) and of legs 2 and 3. The legs 2 will be preferably shorter as compared to the legs 3 so that the bench is inclined slightly to one side.

The side of the legs 3 is fitted with an adjustable support 4 for the patient's feet. The lengthwise adjusting of this support 4 can be obtained, for instance, via a conventional system where a slide 5 to which the adjustable support 4 has been welded, can be shifted along a guide 6 and can then be locked in position against this guide 6 via a setscrew 7.

The numbers 8 and 9 refer to cushions respectively positioned on the bench, and the support 4.

At the end of the bench opposite to the support 4, or any rate quite close to it, has been assembled a vertically revolvable arm 10 that is hinged with regard to the longitudinal girders 1. The geometric hinge axle of the revolvable arm 10 is installed in 11.

To the revolvable arm 10 has been assembled a dorsal support 12. This dorsal support 12 is hinged at 13 to an angle bar 14, one of the arms of which slides in the component part 10' of the aforesaid revolvable arm 10. A setscrew 15 is used to adjust the height of the dorsal support 12 as compared to the component part 10'.

Adjusting the vertically revolvable arm 10 to various positions will be obtained preferably by using a hydraulic cylinder 16 actuated by a small pump (not shown) and that is controlled via a lever 17. The numbers 19 and 20 refer to the hinge points of the hydraulic cylinder 16 with regard, on one hand, to the revolvable arm 10 and, on the other hand, to a component 18 welded to one of the longitudinal girders 1.

The number 21 refers to the patient who is sitting on the apparatus according to the invention and who can also support himself on the horizontal arm of an L-shaped support 22 that can be shifted in the same manner as the support along the guide 6, for which purpose the L-shaped arm has been welded to a slide 23 fitted with a setscrew 24.

In view of exercising the rear leg muscles (postural muscles,) i.e., hamstrings and gastrocnemius, the patient 21 will first sit on the apparatus in a position that corresponds with the position where the vertically revolvable arm 10 is drawn in full lines. The back support 12 that is revolvable in 13 will then also be in the position as drawn in full lines in FIG. 2.

By using a lever 17, the pressure required will be created in the hydraulic cylinder 16, which moves the revolvable arm 10 progressively into the position drawn in FIG. 2 in dot-dash-lines.

The patient or his helper will adjust the pressure required in the hydraulic cylinder 16 until his body has reached a position where the rear leg muscles are pulled. The degree of pulling will be determined by the patient himself. He has to get close to a limit set by the nursing staff and he should not exceed this limit. This limit can also be set by the patient himself and the term "patient" obviously includes the word "practitioner or user" which also covers and refers to athletes.

In the position held by the patient 21 and shown in dot-dash-lines in FIG. 2, the aforesaid rear leg muscles are pulled to a maximum extent and a beneficial effect is being exerted on the lower dorsal muscles, too.

Length and rhythm of the exercises performed by means of the apparatus according to the invention are determined arbitrarily, of course, either by the nursing staff or on the basis of personal experience.

It has been shown that subsequent to having exercised the lower dorsal muscles and the rear leg muscles by means of the apparatus, the patient or user of the apparatus is able to achieve significantly improved bending of his body, essentially of his back, with respect to his stretched legs.

The component part 10' is provided with a graduation 25 that allows for reading the position of the revolvable arm in relation to a finger 26.

As already stated above, the invention is not restricted to the form of embodiment described above and numerous modifications can be applied thereto without exceeding the framework of the patent application.

It is obvious, for instance, that moving the revolvable arm 10 does not necessarily have to be obtained by having a hydraulic cylinder 16 actuate this arm. This can also be achieved through other mechanical means such as, for instance, through a setscrew.

What is claimed is:

1. An apparatus for exercising the rear leg muscles and the lower dorsal muscles of a user, said apparatus comprising a bench having a first end and a second end and including a generally flat support surface on which a user can recline with his feet extending towards said second end, a footrest means which is fixedly connected to said bench to extend upwardly with respect to said support surface, said footrest means being adjustably positionable with respect to the length of said bench, a revolvable support means which is pivotally attached to said bench near its first end, said revolvable support means including a dorsal support element for supporting the back of a user who is reclining on said generally flat support surface of said bench and whose feet are in contact with said footrest means, and drive means connected to said revolvable support means, said drive means, when activated, causing said revolvable support means to pivot relative to said bench such that said dorsal support element will move upwardly and towards said second end of said bench and thereby cause the back of a user to move from a generally reclined position to an upright position generally perpendicular to said generally flat support surface and concurrently stretch the user's rear leg muscles and lower dorsal muscles.

2. An apparatus according to claim 1, wherein said drive means is a hydraulic cylinder.

3. An apparatus according to claim 2, wherein said hydraulic cylinder includes a control arm which can be grasped by a user who is reclined on said bench.

4. An apparatus according to claim 1, wherein said revolvable support means comprises a first angle arm which is pivotally attached to said bench and a second angle arm which is adjustable connected to said first angle arm, and wherein said dorsal support element is pivotally attached to said second angle arm.

5. An apparatus according to claim 1, wherein said bench comprises a frame that includes a plurality of elongated girders and a plurality of legs which are connected to opposite ends of said girders to mount the elongatd girders in a generally horizontal orientation, and wherein a cushion is positioned on said elongated girders.

6. An apparatus according to claim 5, wherein an elongated guide element is mounted to said frame to extend in parallel with said girders, wherein a slide element is adustably positioned along said guide element, and wherein said footrest means is connected to said guide element.

* * * * *